US007503455B2

(12) United States Patent
McDade

(10) Patent No.: US 7,503,455 B2
(45) Date of Patent: Mar. 17, 2009

(54) CROSS-STACKING CONTAINER

(75) Inventor: Clinton McDade, Charlotte, NC (US)

(73) Assignee: Schaefer Systems International, Inc., Charlotte, NC (US)

( * ) Notice: Subject to any disclaimer, the term of this patent is extended or adjusted under 35 U.S.C. 154(b) by 267 days.

(21) Appl. No.: 11/029,433

(22) Filed: Jan. 5, 2005

(65) Prior Publication Data

US 2006/0144743 A1 Jul. 6, 2006

(51) Int. Cl.
*B65D 21/00* (2006.01)

(52) U.S. Cl. ..... 206/511; 206/503; 206/509

(58) Field of Classification Search ..... 206/594, 206/501, 503, 509, 511, 512, 765; 446/124
See application file for complete search history.

(56) References Cited

U.S. PATENT DOCUMENTS 4,744,780 A * 5/1988 Volpe ..... 446/128
5,156,288 A * 10/1992 Levy ..... 206/509
D336,613 S * 6/1993 Zutler ..... D9/423
D336,615 S * 6/1993 Peersmann ..... D10/15
5,743,393 A * 4/1998 Webb et al. ..... 206/319
5,795,210 A * 8/1998 Kushner et al. ..... 446/124
5,876,776 A * 3/1999 Credle, Jr. ..... 426/394
6,595,365 B1 * 7/2003 Wigmore ..... 206/204
6,634,513 B1 * 10/2003 Hardy et al. ..... 211/194

* cited by examiner

*Primary Examiner*—J. Gregory Pickett
(74) *Attorney, Agent, or Firm*—Adams Intellectual Property Law, P.A.

(57) ABSTRACT

A stackable container that can be stacked with containers of various sizes, and that increases available storage volume without increasing weight. The stackable container includes a plurality of sidewalls and an integrally-formed bottom wall. The sidewalls have respective top edges which define a top opening and rim. At least one recess is formed in the bottom wall and extends exteriorly of the container beyond a plane of the bottom wall, and is defined by a perimeter support in the plane of the bottom wall. The recess is dimensioned for being received into a top opening of a second container with a rim of the second container being positioned on the perimeter support of the container for maintaining the container and the second container in stacked alignment with each other.

6 Claims, 6 Drawing Sheets

CROSS-STACKING CONTAINER

TECHNICAL FIELD AND BACKGROUND

This invention relates to a container, and more particularly, to a container including features permitting the container to be stacked with containers of other sizes and shapes. The containers described and claimed herein permit more efficient, compact utilization of space, particularly in assembly areas where consistent container size, position and orientation are important factors in assembly line efficiency.

Stackable containers are well known in the art and come in all shapes and sizes. The regulatory weight limit for hand held containers has recently been reduced from 40 pounds to 35 pounds. Because of this reduction in hand held container weight limits, it has become more important for stackable containers to be as light as possible without sacrificing carrying capacity and versatility.

It is common for stackable containers to have either a flat bottom or a bottom with an outwardly-projecting grid pattern molded onto the bottom that defines a size and shape intended to mate with the size and shape of the opening of another container onto which the container is to be stacked. Stackable containers having a flat bottom lack versatility and do not allow the containers to be stacked on top of multiple smaller containers. For example, a single large flat bottom container cannot be stacked on top of six smaller containers. This restricts the order of stacking boxes, requiring larger boxes to always stack below smaller boxes.

Stackable containers having a molded grid pattern on the bottom tend to stick or hang-up on wheel-type conveyor systems, as well as, also producing an increased amount of conveyor chatter over that produced by a flat bottom container due to gaps between the ribs of the grid pattern which interact with the wheels of the conveyor system. In addition, the grid pattern, being simply molded onto the bottom of the container adds extra weight without increasing capacity. To remain within applicable weight limits, the carrying capacity of a stackable container having a grid pattern is somewhat reduced in comparison to a comparable flat bottom container.

Accordingly, there is a need for a stackable container that incorporates the benefits provided by both a flat bottom container and a container with a grid pattern, while eliminating the deficiencies of both containers.

SUMMARY OF THE INVENTION

Therefore, it is an object of the invention to provide a container that can be stacked with containers of smaller size.

It is another object of the invention to provide a container that avoids container hang-up on a conveyor system.

It is another object of the invention to provide a container that has a greater internal volume than a flat bottom container of the same footprint without increasing the weight of the container.

It is another object of the invention to provide a container that reduces conveyor chatter caused by the interaction between the container and the conveyor system.

It is another object of the invention to provide a container that has an optional panel that can be placed in the container for providing a flat interior bottom wall.

It is another object of the invention to provide a container that can be stacked without sacrificing the container's weight carrying capacity.

These and other objects of the present invention are achieved in the preferred embodiments disclosed below by providing a stackable container including a plurality of sidewalls having respective top edges, an integrally-formed bottom wall, and a top opening and rim defined by the top edge; and at least one recess formed in the bottom wall and extending exteriorly of the container beyond a plane of the bottom wall. The at least one recess is defined by a perimeter support in the plane of the bottom wall and dimensioned for being received into a top opening of a second container with a rim of the second container being positioned on the perimeter support of the container for maintaining the container and the second container in stacked alignment with each other.

According to another preferred embodiment of the invention, the stackable container further includes a removable panel for being inserted into the container so as to cover the at least one recess and provide a flat interior surface for the bottom wall.

According to another preferred embodiment of the invention, the rim has a thickness substantially equal to the distance between an outside edge of the bottom wall and an outside perimeter of the base pad to provide a secure fit between stacked containers.

According to another preferred embodiment of the invention, the container has a stack height equal to the height of the sidewalls of the container.

According to another preferred embodiment of the invention, a stackable container includes a plurality of sidewalls having respective top edges, an integrally-formed bottom, and a top opening and rim defined by the top edge; and a plurality of recesses formed in the bottom wall extending exteriorly of the container beyond a plane of the bottom wall. The plurality of recesses being defined by a perimeter support in the plane of the bottom wall, wherein the recesses collectively define a perimeter dimensioned for being received onto a top opening of a complimentary container with a rim of the complimentary container being positioned on the perimeter support of the container for maintaining the container and the complimentary container in stacked alignment with each other, and wherein one or more of the recesses further define a second perimeter dimensioned for being received into a top opening of a smaller container with a rim of the smaller container being positioned on the perimeter support of the container for maintaining the container and the smaller container in stacked alignment with each other.

According to another preferred embodiment of the invention, at least two recesses collectively define the second perimeter dimensioned for being received into the top opening of the smaller container for maintaining the container and smaller container in stacked alignment with each other.

According to another preferred embodiment of the invention, each of the respective recesses defines the second perimeter dimensioned for being received into the top opening of the smaller container for maintaining the container and smaller container in stacked alignment with each other.

According to another preferred embodiment of the invention, a stackable container includes a plurality sidewalls collectively defining respective top edges, an integrally-formed bottom wall, and a top opening defined by the top edge, wherein the sidewalls and bottom wall cooperate to form a rectangular container; and a plurality of recesses formed in the bottom wall extending exteriorly of the container beyond a plane of the bottom wall. The plurality of recesses being defined by a perimeter support in the plane of the bottom of the wall, wherein the recesses collectively define a perimeter dimensioned for being received onto a top opening of a complimentary container with a rim of the complimentary container being positioned on the perimeter support of the container for maintaining the container and the complimentary container in stacked alignment with each other and having a stack height equal to the height of the sidewalls of the container, and wherein one or more of the recesses further define a second perimeter dimensioned for being received into a top opening of a smaller container with a rim of the smaller container being positioned on the perimeter support of the container for maintaining the container and smaller container in stacked alignment with each other and having a stack height equal to a height of the sidewalls of the container.

BRIEF DESCRIPTION OF DRAWINGS

Some of the objects of the invention have been set forth above. Other objects and advantages of the invention will appear as the invention proceeds when taken in conjunction with the following drawings, in which.

DESCRIPTION OF THE PREFERRED EMBODIMENT AND BEST MODE

Figure 1:
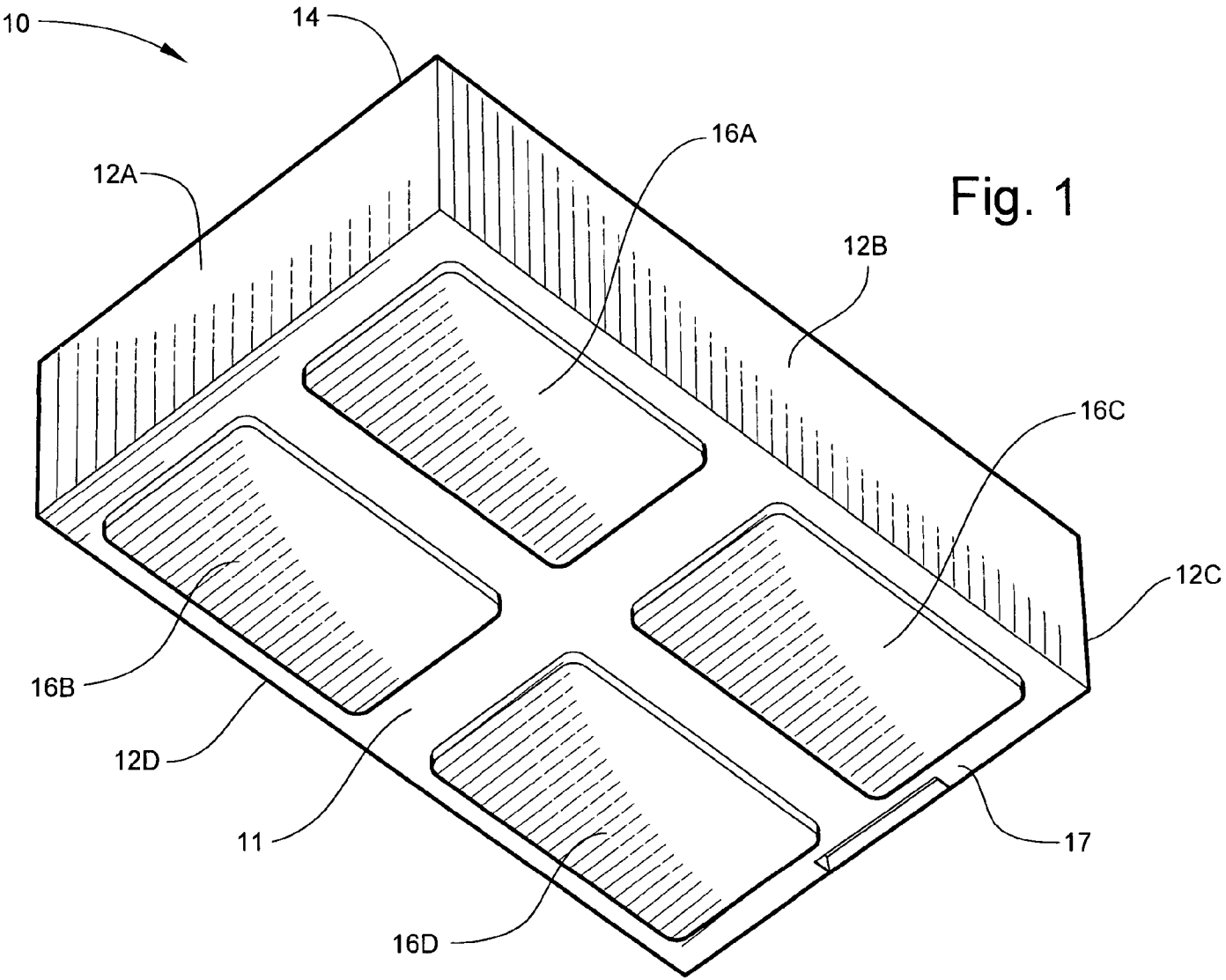
FIG. 1 shows a bottom perspective view of a container according to an embodiment of the invention.
Figure 2:
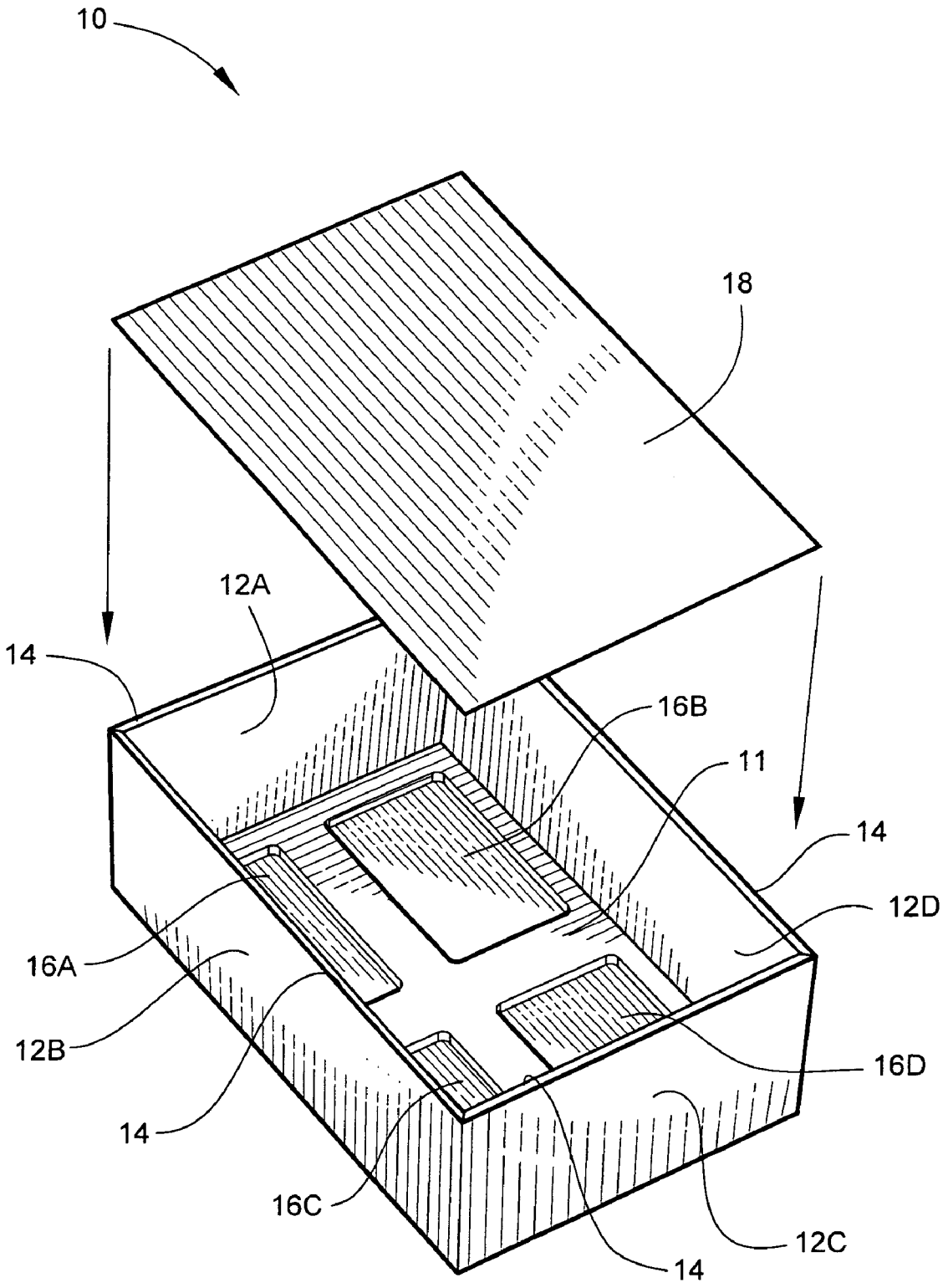
FIG. 2 shows an exploded view of the container of FIG. 1 and a false bottom.

Referring now specifically to the drawings, a container according to an embodiment of the invention is illustrated in FIGS. 1 and 2 and shown generally at reference numeral 10.

The container 10 includes a bottom wall 11 and integrally-molded sidewalls 12A-12D. The sidewalls 12A-12D collectively define a rim 14 that extends around the perimeter of a top edge of the container 10 for supporting another container in a stacked configuration. The container 10 is made of a material suitable for supporting containers in a stacked configuration and for providing a long life cycle. In the illustrated example, the container 10 is made of a polyethylene plastic.

The interior side of the bottom wall 11 includes four molded-in recesses 16A-16D. The recesses 16A-16D preferably lack any reinforcing features such as a grid that would add tare weight or interfere with the ability of the recesses to furnish additional capacity. The container 10 thus holds a greater volume of material than a box of the same footprint with a grid on the bottom, while decreasing its weight.

The recesses 16A-16D result in a bottom wall 11 having an interior surface that is not completely and uniformly flat. In the event that a flat interior surface is required, the recesses 16A-16D may be filled or covered. A dunnage set (not shown) with raised bottom sections that fit into the recesses 16A-16D may be utilized to uniformly position the container contents for ready access. Alternatively, an optional removable panel 18, as shown in FIG. 2, may be inserted into the container 10 to cover the recesses 16A-16D and form a flat interior surface for the bottom wall 11.

Figure 3:
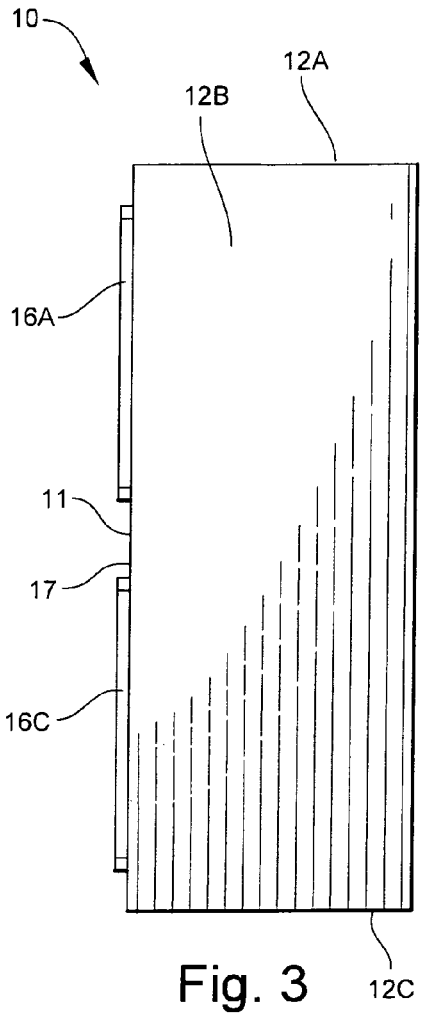
FIG. 3 shows a side plan view of the container of FIG. 1.
Figure 4:
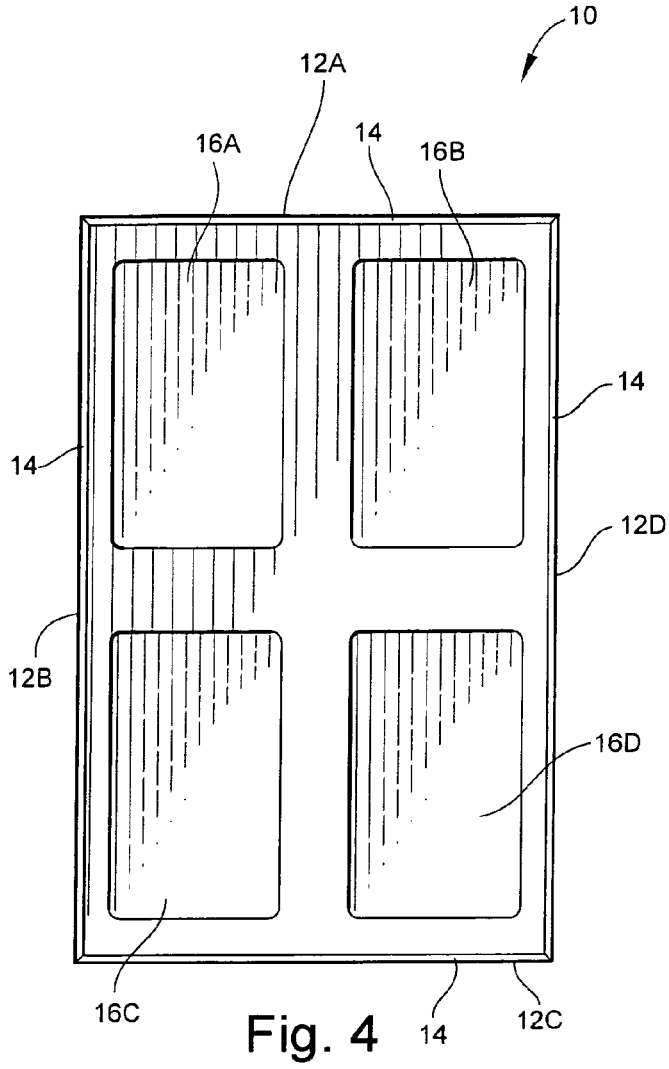
FIG. 4 shows a top plan view of the container of FIG. 1.
Figure 5:
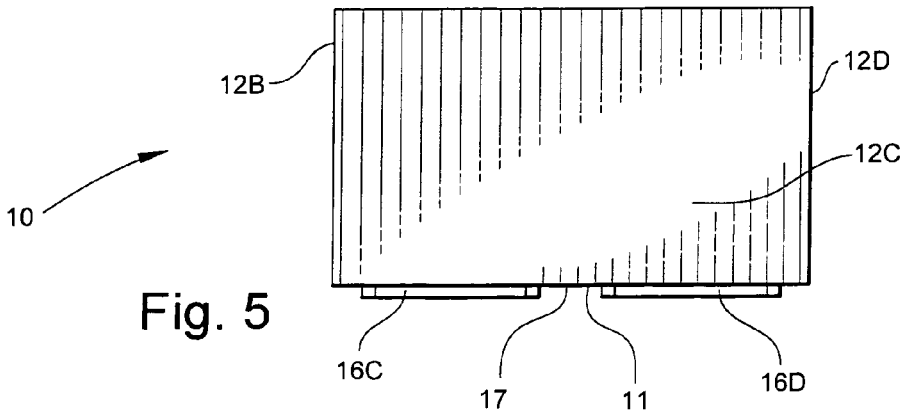
FIG. 5 shows an end plan view of the container of FIG. 1.

Referring to FIGS. 3-5, the sidewalls 12A-12D are substantially perpendicular to the bottom wall 11, and prevent the container 10 from nesting within an identical container (not shown), allowing the containers to be stacked without a substantial loss of interior volume. Only the exterior of the recesses 16A-16D extend into the opening of the bottom container, securing the containers in a stacked configuration and providing a stack height equal to the height of the sidewalls 12A-12D.

Figure 6:
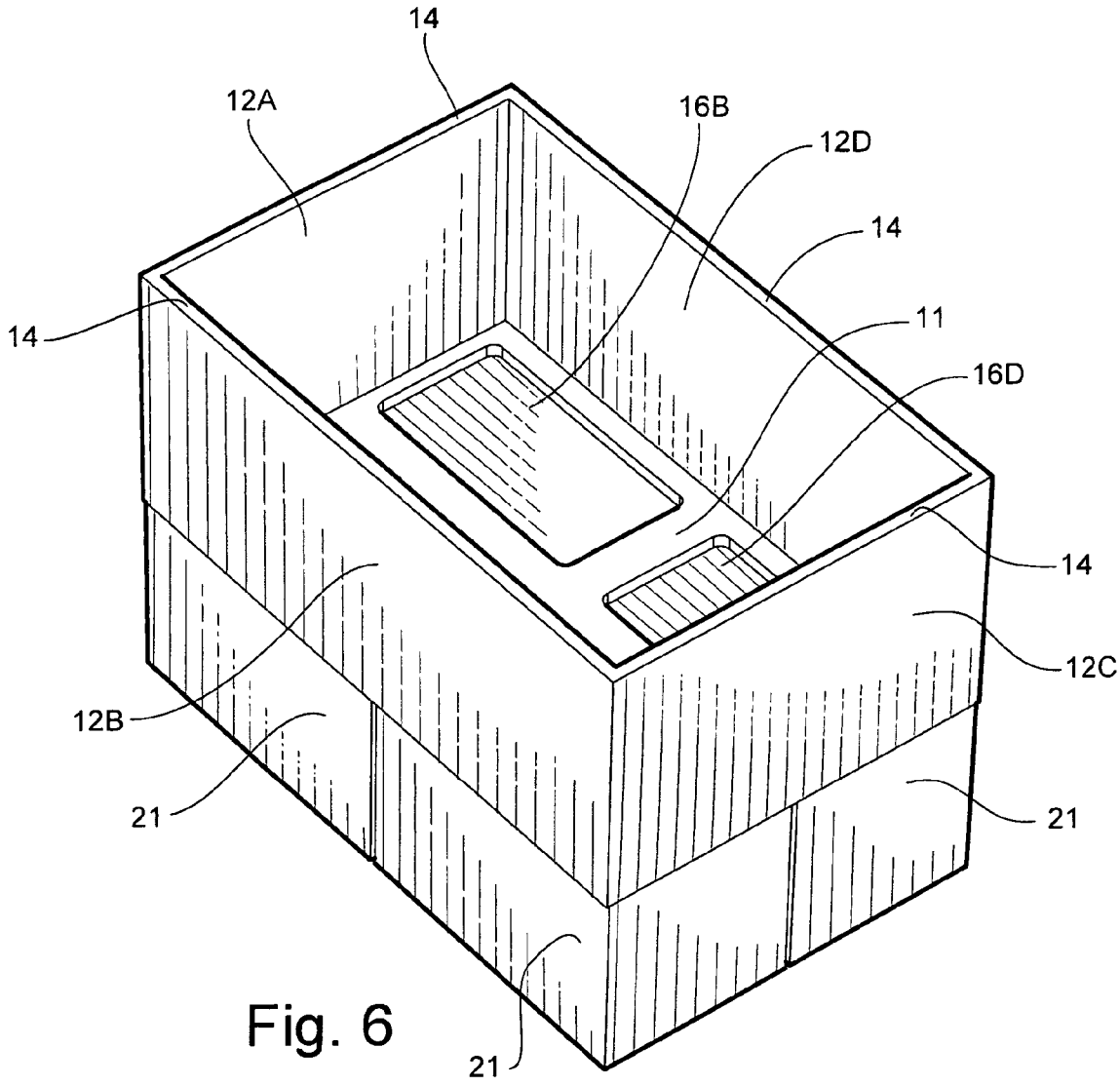
FIG. 6 shows a top perspective view of the container of FIG. 1 stacked with smaller containers.

The recesses 16A-16D extend exteriorly of the container 10 beyond a plane of the bottom wall 11 in a spaced-apart arrangement and are individually sized to fit snugly within respective openings of smaller containers, such as shown in FIG. 6, to reduce the amount of lateral movement between each of the recesses 16A-16D and the respective openings, and provide a secure stacking arrangement. The recesses 16A-16D collectively define a perimeter sized to fit snugly within an identical container (not shown) or a variety of containers of other sizes for securing the container 10 in a stacked configuration.

The recesses 16A-16D are defined individually and collectively by a perimeter support 17 in the plane of the bottom wall. The container 10 is stacked with a second container (not shown) by positioning the perimeter support 17 on the rim of the second container, allowing the recesses 16A-16D to project into the top opening of the second container. As illustrated in FIG. 4, the container 10 has four recesses 16A-16D, however, the number of recesses could be more or less depending on a user's needs.

When the container 10 is used on a conveyor system, the recesses 16A-16D reduce the amount of conveyor chatter compared to containers having a grid on the bottom by eliminating the gaps associated with grids and providing a larger continuous surface area for contact with the conveyor wheels. The base wall 20 may have a smooth or textured surface depending on the needs of the user.

The rim 14 may be of any suitable thickness for supporting another container in a stacked configuration. For example, the thickness can be substantially equivalent to the spacing between the outside edge of the container 10 and the combined outside perimeter of the four recesses 16A-16D to provide a secure fit between identical stacked containers, thereby, reducing the instability otherwise inherently present when stacking multiple containers.

As shown in FIG. 6, the container 10 may be stacked with smaller containers 21. The recesses 16A-16D project into the openings of the containers 21, securing the containers 21 in a stacked position relative to the container 10. The spacing of the recesses 16A-16D allows a top edge of each of the containers 21 to rest against the bottom wall 11 and perimeter support 17 of the container 10 without interference. In the particular embodiment shown and described in this application the recesses 16A-16D are rectilinear. However, these recesses may have differing shapes, such as round or elliptical, and may be provided with chamfered or keyed corners. External ribs may also used in combination with the recesses to provide enhanced strength and rigidity.

Figure 7:
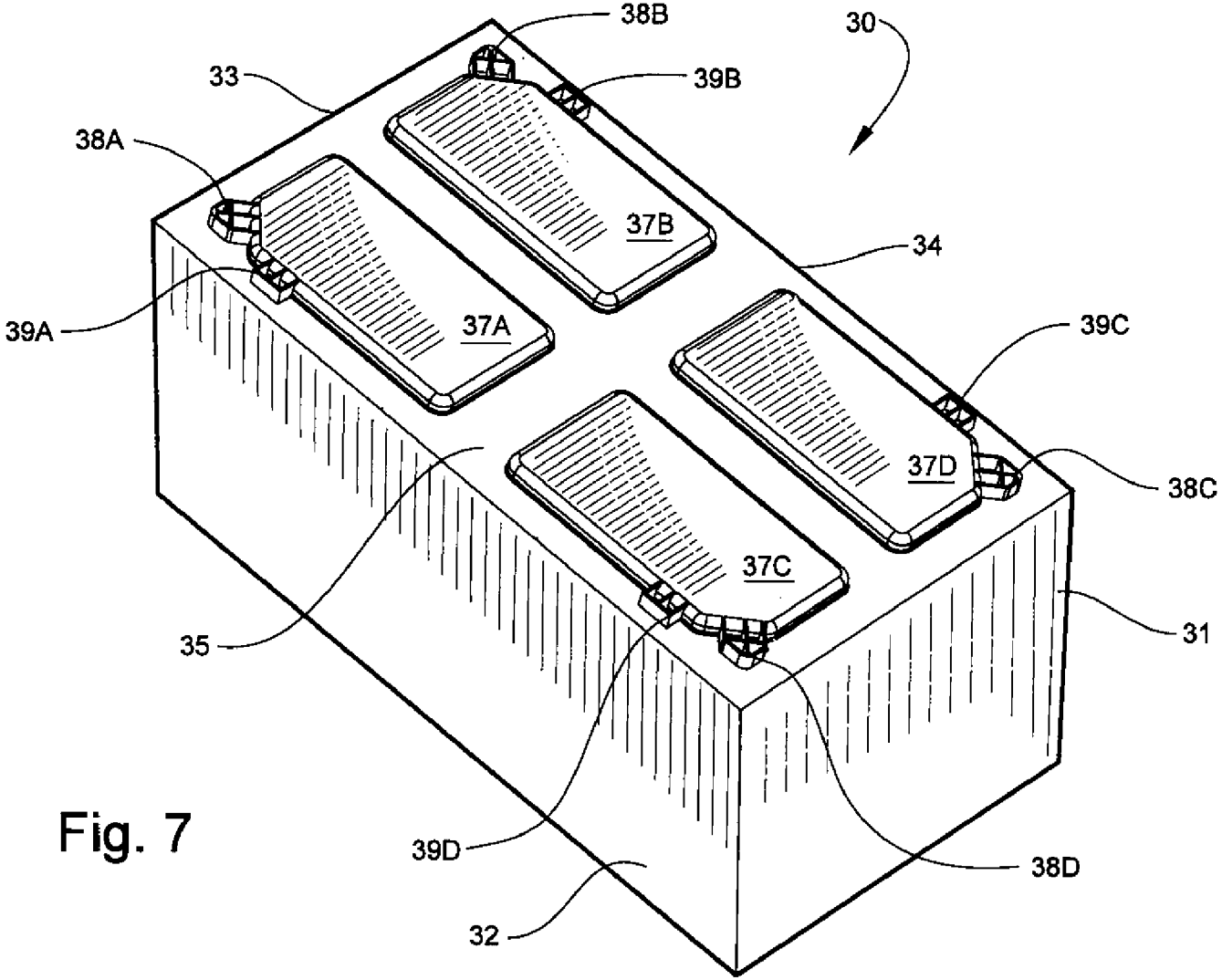
FIG. 7 is a bottom perspective view of a cross-stacking container according to an alternative embodiment.

For example, FIG. 7 illustrates such a design with reference to a container 30 having sidewalls 31-34 and a bottom 35. The bottom 35 is provided with four integrally-molded, outwardly-projecting recesses 37A-D formed in the bottom wall and extending exteriorly of the container 30 beyond a plane of the bottom wall 35. Each of the recesses 37A-D include outwardly extending blocks 38A-D and 39A-D, respectively. These blocks 38A-D and 39A-D permits the container 30 to be used with containers having the same overall size but with a top rim having a larger perimeter by accommodating additional space between the perimeter of the recesses 39A-D and the rim of the container onto which it is stacked without the addition of significant additional weight or material, and by holding the container 30 in a centered condition in the container opening.

Figure 8:
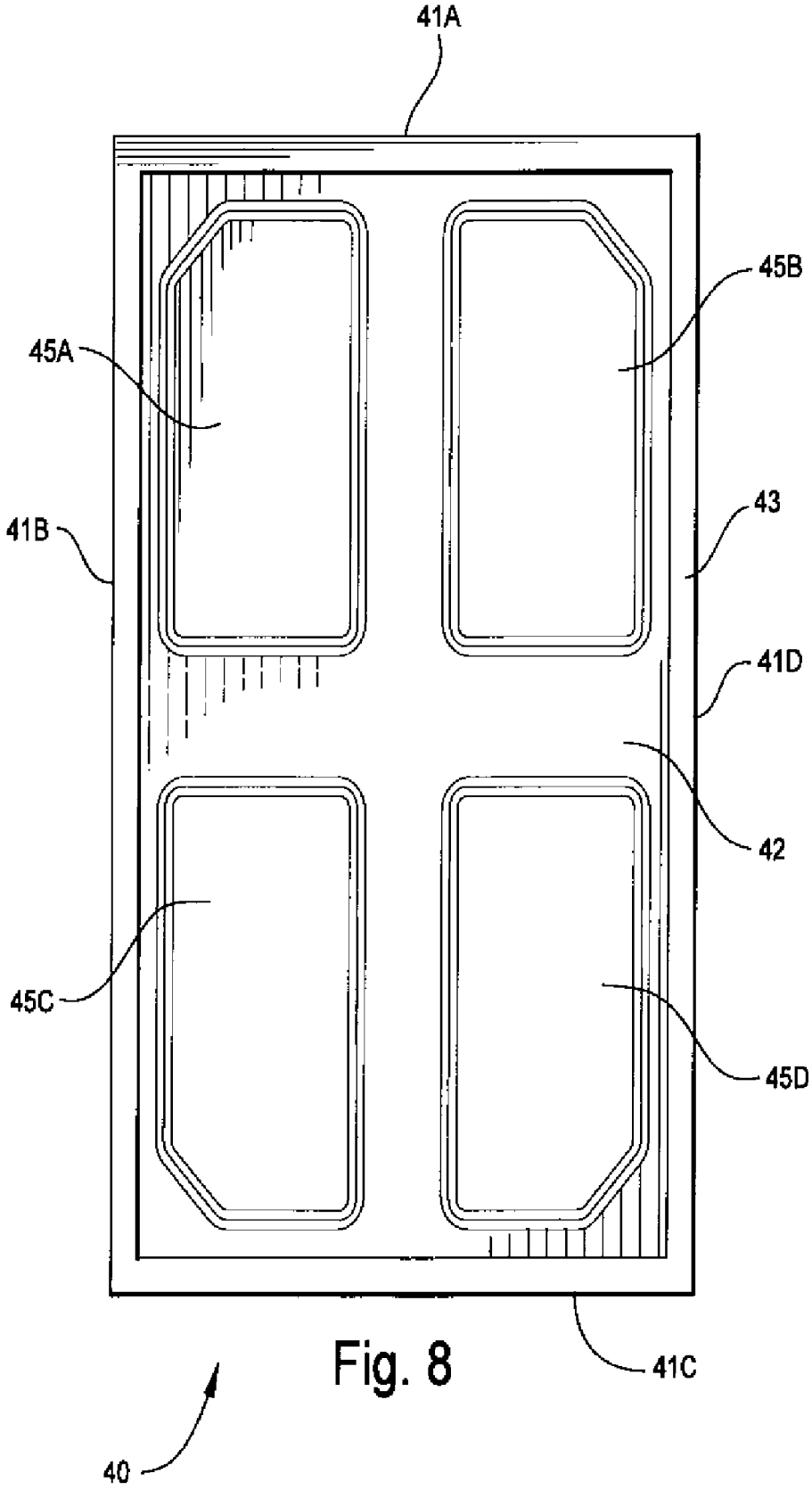
FIG. 8 is a top plan view of a container with which the container of FIG. 7 is adapted to stack.

FIG. 8 illustrates a container 40 having sidewalls 41A-D, a bottom 42 and a top rim 43. Recesses 45A-D are formed in the bottom and extend exteriorly of the container 40 beyond the plane of the bottom wall 42. The rim 43 supports the container 30, and the blocks 38A-D and 39A-D create interference with the rim 43 and center the container 30 in the top opening of the container 40. This is just one example of many iterations by which the invention accomplishes the purpose of facilitating cross-stacking of containers.

A stackable container is described above. Various details of the invention may be changed without departing from its scope. Furthermore, the foregoing description of the preferred embodiments of the invention and the best mode for practicing the invention are provided for the purpose of illustration only and not for the purpose of limitation, the invention being identified in the claims.

I claim:

1. A stackable container, comprising:

(a) a plurality of sidewalls having respective top edges, an integrally-formed bottom wall, and a top opening and rim defined by the top edges; and (b) a plurality of recesses formed in the bottom wall and defining a corresponding plurality of pads extending exteriorly of the container beyond a plane of the bottom wall, the plurality of pads collectively defining a majority of the surface area of the bottom wall to provide a continuous surface to reduce conveyor chatter, the plurality of pads defining a perimeter support around the perimeter of the bottom wall for seating upon a rim of a smaller, similarly-constructed container while preventing lateral movement between the containers, and defining space between individual pads for seating upon adjacent rims of smaller, similarly-constructed containers; and (c) at least one block molded into the bottom on the container exteriorly of the container beyond a plane of the bottom wall and extending laterally outwardly from each of the plurality of pads toward the perimeter support, thereby increasing the footprint of each of the plurality of pads and defining the perimeter support.

2. The stackable container according to claim 1, further comprising a removable panel for being inserted into the container so as to cover each of the recesses and provide a flat interior surface for the bottom wall.

3. The stackable container according to claim 1, wherein the rim has a thickness substantially equal to the distance between the outside edge of the bottom wall and the outside perimeter of the plurality of pads to provide a secure fit between stacked containers.

4. The stackable container according to claim 1, wherein the plurality of pads are spaced-apart to allow each one of the respective pads to stack with a smaller container without interference.

5. The stackable container according to claim 1, wherein at least two pads collectively define the second perimeter dimensioned for being received into the top opening of the smaller container for maintaining the container and smaller container in stacked alignment with each other.

6. The stackable container according to claim 1, wherein each of the respective pads defines the second perimeter dimensioned for being received into the top opening of the smaller container for maintaining the container and smaller container in stacked alignment with each other.

* * * * *